US005481785A

United States Patent [19]

Minton et al.

[11] Patent Number: 5,481,785

[45] Date of Patent: Jan. 9, 1996

[54] REUSABLE CASKET ASSEMBLY

[76] Inventors: Roy H. Minton, 905 N. Caraway; Douglas L. Barker, 2213 Shoshoni, both of Jonesboro, Ark. 72401

[21] Appl. No.: 262,557

[22] Filed: Jun. 20, 1994

[51] Int. Cl.[6] ..... A61G 17/00

[52] U.S. Cl. ..... 27/27; 27/19; 27/35

[58] Field of Search ..... 27/27, 35, 19; 220/258, 434

[56] References Cited

U.S. PATENT DOCUMENTS

| | | | |
|---|---|---|---|
| 1,001,424 | 8/1911 | Montross | 27/27 |
| 3,613,189 | 10/1971 | Kirby | 27/35 |
| 3,654,676 | 4/1972 | McHugh | 27/2 |
| 3,810,282 | 5/1974 | Doggett | 27/35 |
| 3,815,185 | 6/1974 | Owens | 27/3 |
| 4,063,337 | 12/1977 | Havey | 27/35 X |
| 4,151,630 | 5/1979 | Havey | 27/2 |
| 4,177,543 | 12/1979 | Angermann | 27/35 |
| 4,237,590 | 12/1980 | Work | 27/35 |
| 4,249,289 | 2/1981 | Work | 27/35 |
| 4,265,006 | 5/1981 | Angermann | 27/14 |
| 4,337,556 | 7/1982 | Winburn et al. | 27/2 |
| 4,727,632 | 3/1988 | Yearsley | 27/35 |
| 4,788,757 | 12/1988 | Bethune et al. | 27/2 |
| 5,349,727 | 9/1994 | Niebergall | 27/19 X |

*Primary Examiner*—Carl D. Friedman
*Assistant Examiner*—Beth A. Aubrey
*Attorney, Agent, or Firm*—Stephen D. Carver; Trent C. Keisling

[57] ABSTRACT

A reusable casket assembly comprising a two part burial system comprising an ornate, reusable outer shell that is mated to an inner capsule. The decorative shell esthetically and operationally covers the inner capsule in which the body is interred. The inner capsule functions without the outer shell. A preexisting ornate casket is converted into an ornate outer shell by simply removing the interior padding and bottom of the preexisting casket. Pins installed in the outer shell selectively lock the inner capsule therein. The inner capsule is preferably molded of durable plastic. Esthetic ornamentation is added to the exterior of the capsule to provide a suitable appearance. The inner capsule has indents molded into its side walls that selectively receive suitable pins installed in the outer shell. While the outer shell is combined with the capsule, the casket assembly functions and appears as a unitary casket. Alternatively, the inner capsule may be used alone. A unique handle system attaches to the inner capsule to facilitate its movement without the outer shell. The capsule is hermetically sealed prior to burial and the interior of the capsule may be pressurized with an inert gas to preserve the deceased.

18 Claims, 8 Drawing Sheets

REUSABLE CASKET ASSEMBLY

BACKGROUND OF THE INVENTION

I. Field of the Invention

Our invention relates generally to burial caskets used in the undertaking and funeral industry. More particularly, the invention relates to casket assemblies that combine the aesthetic appearance of a typical ornate casket with an inexpensive inner capsule that is removed from the casket shell before burial. Relevant prior art casket assemblies may be found in United States Patent Class 27 and the many subclasses listed thereunder.

II. Description of the Prior Art

Traditionally, a deceased is interned within a burial casket that is aesthetically ornamented and normally quite expensive. As will be recognized by those skilled in the art, the primary expense of most funerals is the cost of the casket. Caskets are expensive because of their ornamented construction and the materials employed therein. Prior art casket assemblies have attempted to overcome this expense by combining inexpensive inner capsules with reusable outer ornate shells or surrounds.

Examples of this approach are seen in U.S. Pat. Nos. 3,613,189; 3,654,676; 4,265,006; 4,249,289; 4,337,556 and 4,788,757. These prior art devices disclose several attempts to alleviate the expenses of purchasing a traditional ornate casket by utilizing an expensive reusable outer shell and an inexpensive inner capsule. However, these systems fail to adequately utilize the existing supply of ornate caskets by providing a method of retrofitting these caskets with an inner capsule. Also, the inner capsules do not selectively function singularly without the outer shell.

An interesting device is disclosed in U.S. Pat. No. 3,815,185. The side and end walls of the outer shell (casket) are suspended on the sides of the inner capsule (coffin). This device suffers from many of the same problems as the other prior art devices.

Another approach at solving the expense of a traditional casket is seen in U.S. Pat. No. 4,151,630. The device disclosed therein is a casket comprised of inexpensive waxed cardboard material. One of the advantages of this device is its compact storage prior to its use. Unfortunately, this device lacks the structural strength of conventional caskets and fails to adequately preserve the integrity of the burial vault as well as the solemnness of the burial services.

Therefore, it is desirous to provide a casket assembly utilizing an esthetically attractive ornate reusable outer shell and an inexpensive inner capsule. It is also desirous that the inner capsule facilitate subsequent handling after removal from the outer shell. Further, it is desirous that the locking assembly for the capsule and shell also function to lock the capsule handling assembly to the capsule.

SUMMARY OF THE INVENTION

We have provided a reusable unitary casket assembly comprising a two part burial system. One part of the system utilizes an ornate, reusable outer shell that is esthetically pleasing. The second part of the system utilizes an inexpensive inner capsule in which the body is interred for burial. The inner capsule also functions singularly without the outer shell.

In our casket assembly, a conventional, preexisting ornate casket is converted into an ornate outer shell by simply removing the interior padding and bottom of the preexisting casket. Then, pins are installed in the outer shell to selectively lock the inner capsule therein.

The inner capsule is preferably molded of durable plastic. Esthetic ornamentation is added to the exterior of the capsule to provide a suitable appearance. Pin holes molded into the side walls of the inner capsule captivate the pins installed in the outer shell. The casket assembly functions as a unitary casket when the outer shell encapsulates the inner capsule. Subsequently, the pin holes captivate studs protruding from a unique handle system that permits the capsule to be moved without the outer shell.

Generally, the inner capsule resides within the outer shell to form a unitary casket during the memorial and processional services. Alternatively, the inner capsule may be used alone for the memorial and processional services. After the services, the capsule is hermetically sealed for burial. A stable gas may be pumped into the inner capsule to pressurize the interior. A unique handle system attaches to the inner capsule to facilitate its movement without the outer shell.

Novel handles attach to the capsule upon its removal from the shell to facilitate movement of the capsule. The inner capsule is ornamented and decorated so that it is esthetically pleasing. This facilitates its singular use at the grave site.

Thus a basic object of the present invention is to provide a burial system in which an outer, decorative shell and a complementary, inexpensive inner capsule may be coupled together to provide a unitary casket.

A further object of the present invention is to provide a burial system in which a reusable outer shell is ceremonially used to cover an inexpensive inner capsule.

Another object is to provide a system of the character described that is quickly and easily assembled and disassembled.

A related object is to provide an auxiliary handle assembly that easily mates to the inner capsule.

Another object of the present invention is to provide an inexpensive capsule that may be handled independently of an outer shell.

A related object is to provide an ornate outer shell that is adapted to be reused.

Another basic object of the present invention is to utilize existing ornate caskets to form an outer shell for decoratively covering a burial capsule.

Another basic object is to provide an inner capsule that is capable of being used alone or in combination with an ornate outer shell.

Another object of the present invention is to provide a functional inner capsule for burial that is inexpensive.

A basic object of the present invention is to provide a casket of simple and inexpensive construction whereby the cost of funerals will be diminished.

A basic object of the present invention is to provide a simple handle system for moving a casket.

A still further object of the present invention is to provide a removable handle assembly that may be selectively attached to a casket.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
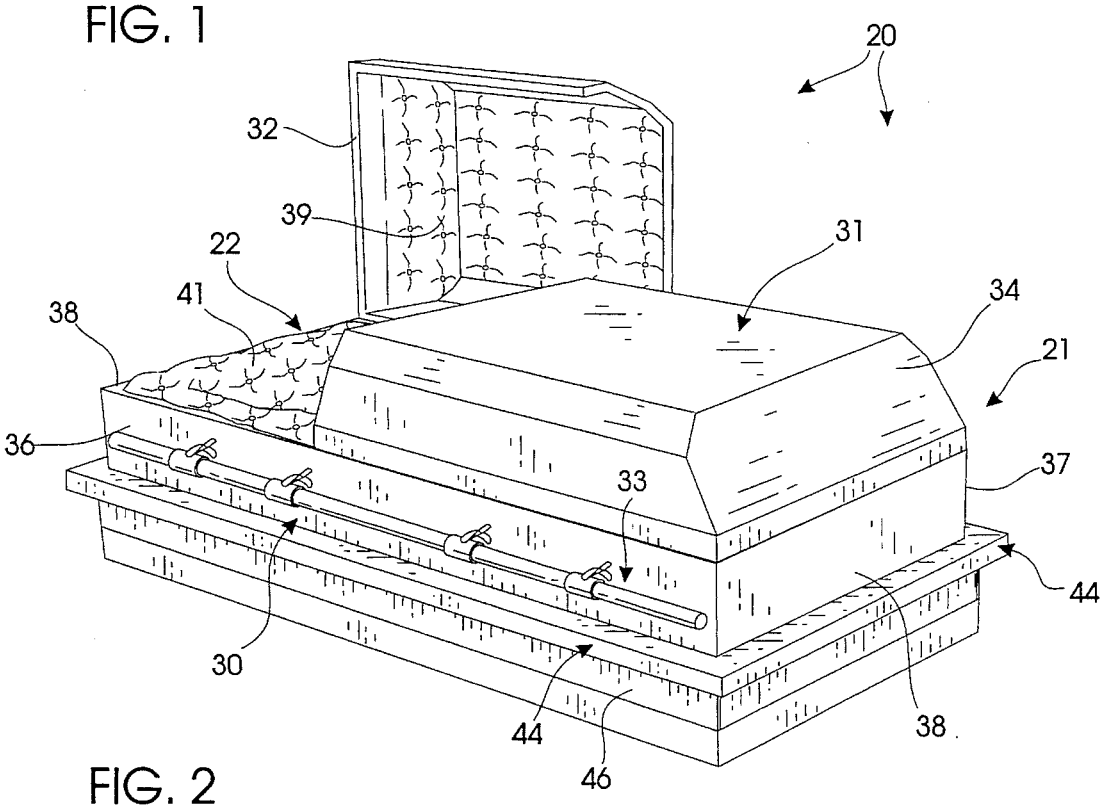
FIG. 1 is a perspective view of the best mode of our casket assembly with the front section of the shell cover shown open, with the capsule disposed within the shell ready for use.
Figure 2:
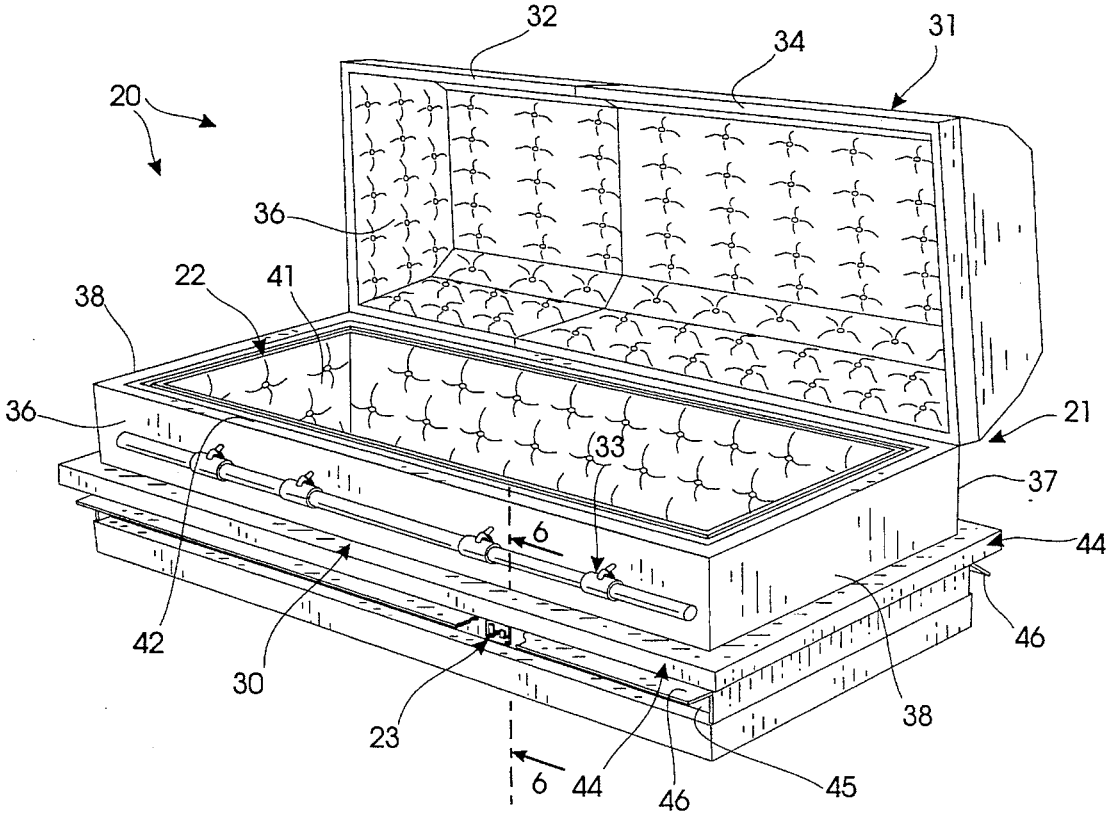
FIG. 2 is a fragmentary, perspective view of the casket assembly similar to FIG. 1, with the entire shell cover open illustrating the hinged covers of the pin assembly, with portions broken away or omitted for clarity.

Referring more specifically to the drawings, our improved reusable casket assembly is broadly designated by the reference number 20 in the drawings. The casket assembly 20 primarily comprises outer shell 21 and inner capsule 22 (FIGS. 1, 2 and 3).

Figure 3:
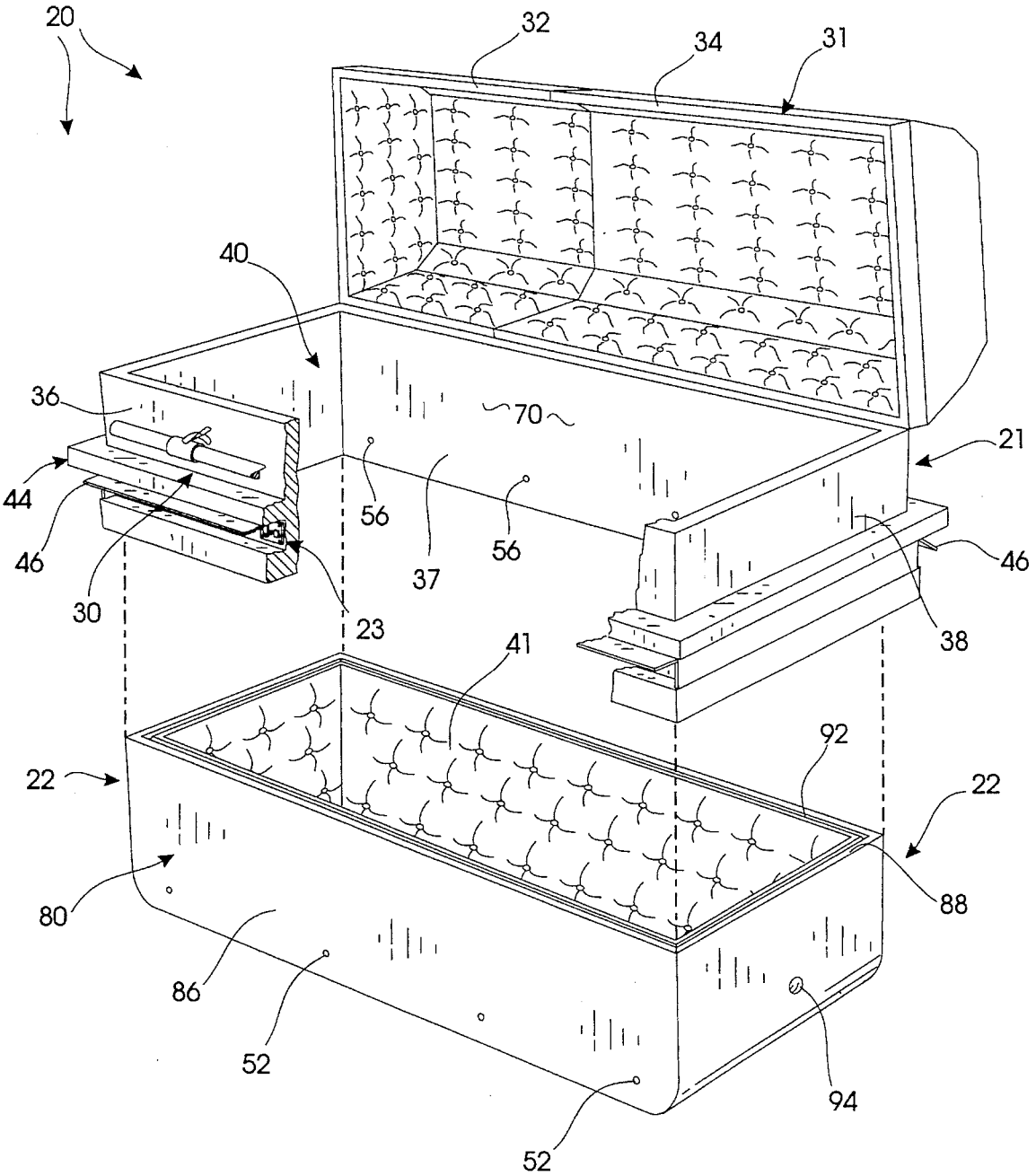
FIG. 3 is an exploded, fragmentary perspective view of the capsule and the shell with the entire shell lid open, illustrating alignment of the capsule inside the shell, with portions broken away or omitted for clarity.

The principle components of the unitary casket assembly 20 are combined by aligning the shell 20 over the capsule 22 and then lowering the shell 20 to surround the capsule 22, as is best seen in FIG. 3. The pin assembly 23 is then engaged to lock the capsule 22 within the shell 21. Before burial, the shell 21 is uncoupled from the capsule 22 by disengaging the pin assembly 23. The outer shell 21 then simply lifts upwardly for storage and subsequent reuse.

The outer shell 21 resembles a typical ornate casket that is well-known in the funeral and undertaking industry. The shell 21 has a body or frame 30 covered by a lid 31. The lid 31 splits into two sections, the head section 32 and the foot section 34. The head section 32 may be opened during viewing of the deceased. However, the entire lid 31 will often need to be opened to prepare the deceased for burial or for other reasons.

The frame 30 has a front side 36 and a rear side 37 and two end walls 38. The lid 31 is mounted by hinges to the rear side 37. Often, the lid 31 is lined with upholstery or padding such as a liner 39. Optional handles 33 facilitate moving of the shell.

Most standard caskets in the industry can be easily retrofitted by simply removing the liner from the interior of the frame 30 of the casket 21 and removing the bottom to form a hollow chamber 40. The outer casket shell 21 may be retrofitted to mate with the inner capsule 22. A pin assembly 23 must also be added to the sides of the casket. This retrofitting procedure allows anyone already possessing a casket to convert that casket into our reusable casket assembly. Alternatively, specialized Shells may be constructed to be used in our casket assembly 20.

The unitary casket assembly 20 results from the coupling together of shell 21 and capsule 22. As seen in FIGS. 1–3, the hollow chamber 40 is formed by the sides 36, 37 and end walls 38 of outer shell 21. When the shell is lowered (i.e., from the position of FIG. 3) the chamber 40 snugly receives the inner capsule 22. Capsule liner 41 extends to cover the juncture 42 between the capsule 22 and the shell 21. This arrangement imbues an esthetically pleasing appearance to the casket assembly 20 that promotes ceremonial dignity.

Figure 4:
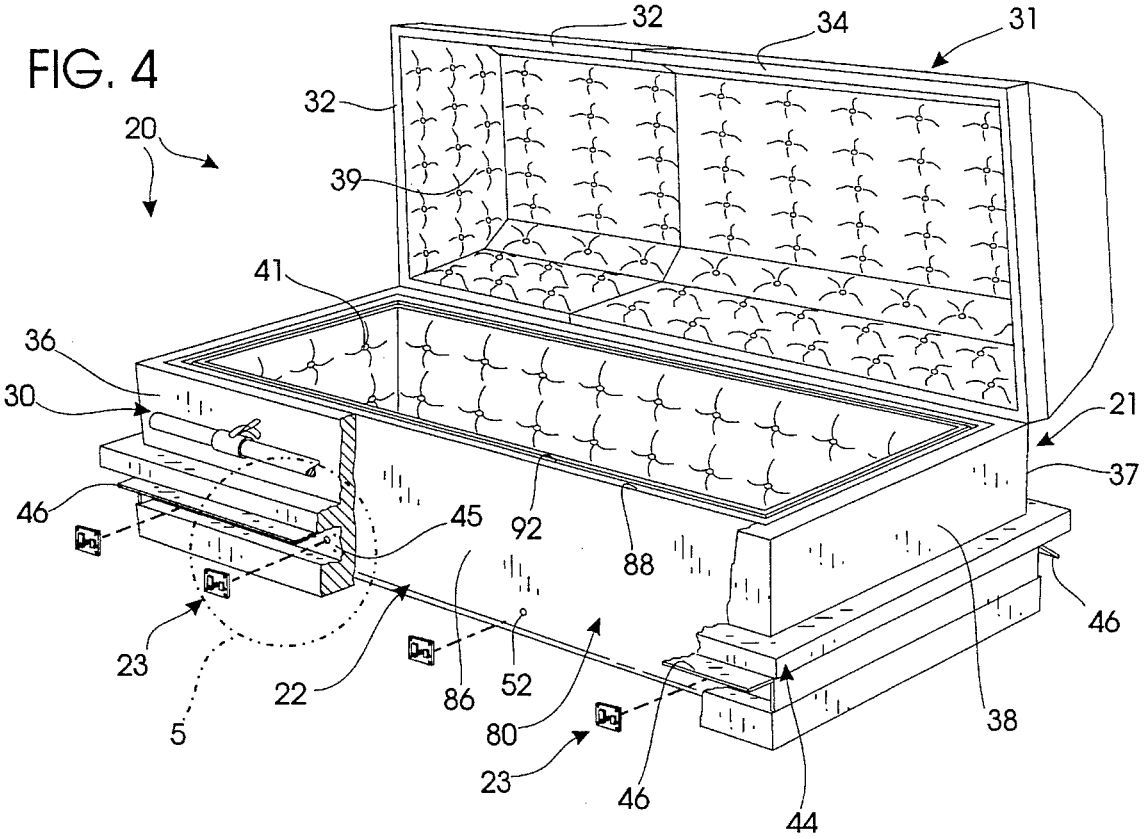
FIG. 4 is an exploded, fragmentary perspective view of the casket assembly similar to FIG. 2, illustrating the attachment of the pins, with portions broken away or omitted for clarity.

The inner capsule 22 locks into the shell 21 with pin assemblies 23 to form the unitary casket assembly 20 (FIG. 4). Multiple pin assemblies 23 (i.e., FIGS. 4, 5) are mounted beneath a peripheral, external decorative ledge 44 within a channel 45. Normally a hinged cover plate 46 (FIG. 2) decoratively covers channel 45 and the pin assemblies therein.

Figure 5:
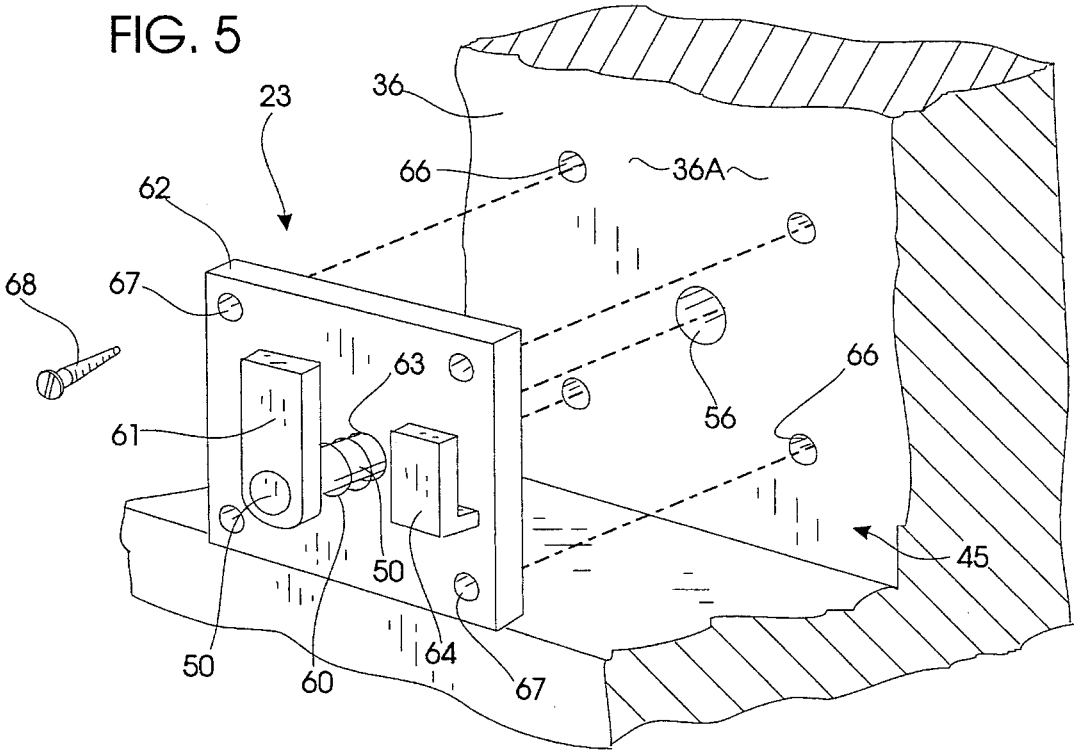
FIG. 5 is a greatly enlarged view of the encircled portion of FIG. 4, illustrating the attachment of the pins to the shell, with portions broken away or omitted for clarity.

As best seen in FIG. 5, each pin assembly 23 comprises a rectangular mounting plate 62 that is mounted within channel 45 upon surface portion 36A of wall 36. Plate 62 can be secured by fasteners 68 that penetrate orifices 67. Elongated coupling pin 50 penetrates hole 63 in plate 62 and is axially disposed within passageway 56. Spring 60 coaxially mounted on pin 50 extends between the face 63 of plate 62, and the tab 61 press fitted to the pin 50 to normally bias pin 50 to the position illustrated in FIGS. 5 and 6. Each pin 50 is retained by a snap ring 53 that abuts plate 62 when the pin moves outwardly (i.e., as viewed in FIGS. 6–8 ).

When the pin is moved inwardly into engagement within an aligned indent 52 formed or molded in the capsule side walls 54, the capsule is coupled to the shell. Tab 61 mounted to the exterior end of each pin 50 aids in manual manipulation. An L-shaped lath 64 spaced apart from pin 50 is secured to the face of plate 62. After the pin is pressed inwardly (FIG. 7), tab 61 may be rotated to the position of FIG. 8 to lock the pin against latch 64 (FIG. 8). Latch 64 holds tab 61 against pressure from spring 60.

Figure 6:
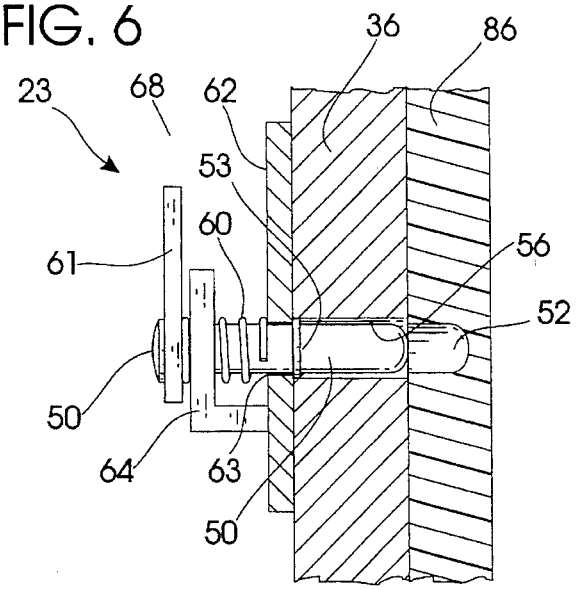
FIG. 6 is an enlarged sectional view taken along line 6—6 of FIG. 2, illustrating a disengaged locking pin, with portions broken away or omitted for clarity.
Figure 7:
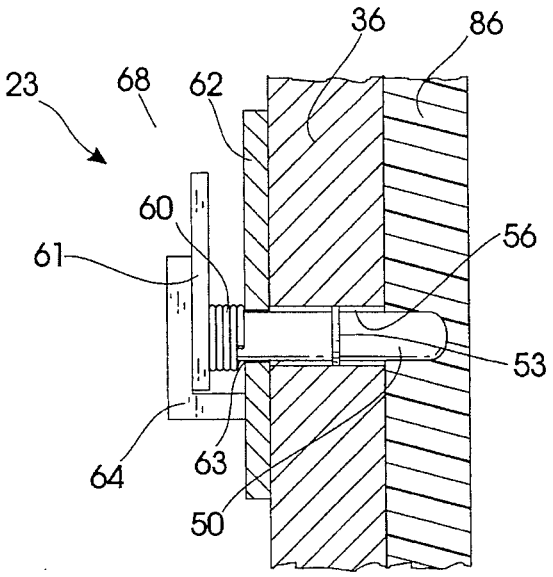
FIG. 7 is a sectional view similar to FIG. 6 illustrating the locking pin in an engaged position, with portions broken away or omitted for clarity.
Figure 8:
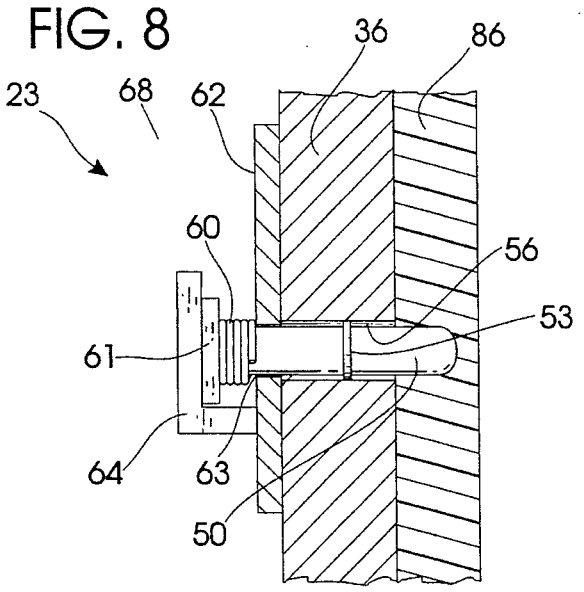
FIG. 8 is a sectional view similar to FIGS. 6 and 7, illustrating the locking pin in an engaged, latched position, with portions broken away or omitted for clarity.
Figure 9:
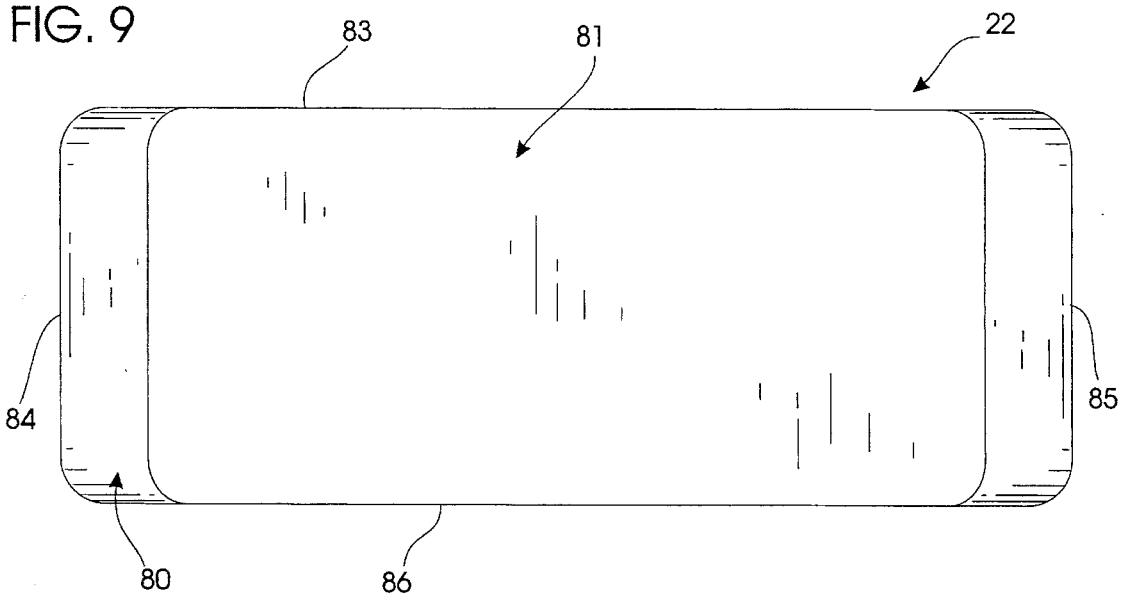
FIG. 9 is a top plan view of the assembled capsule, showing it removed from the outer shell prior to internment.
Figure 10:
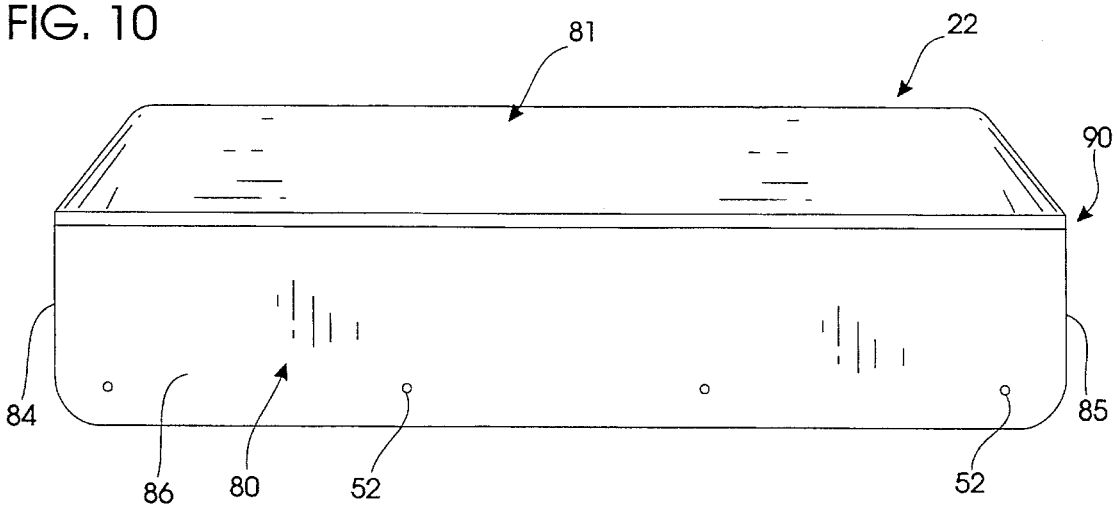
FIG. 10 is a side elevational view of the assembled capsule of FIG. 9.
Figure 11:
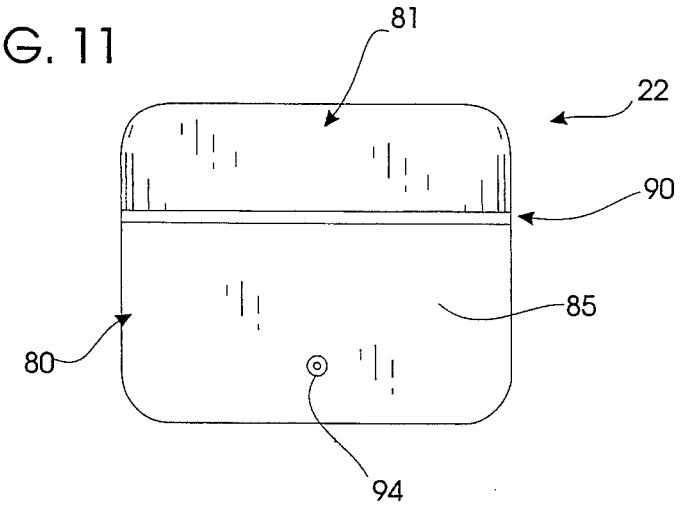
FIG. 11 is an end elevational view of the assembled capsule of FIGS. 9 and 10.
Figure 12:
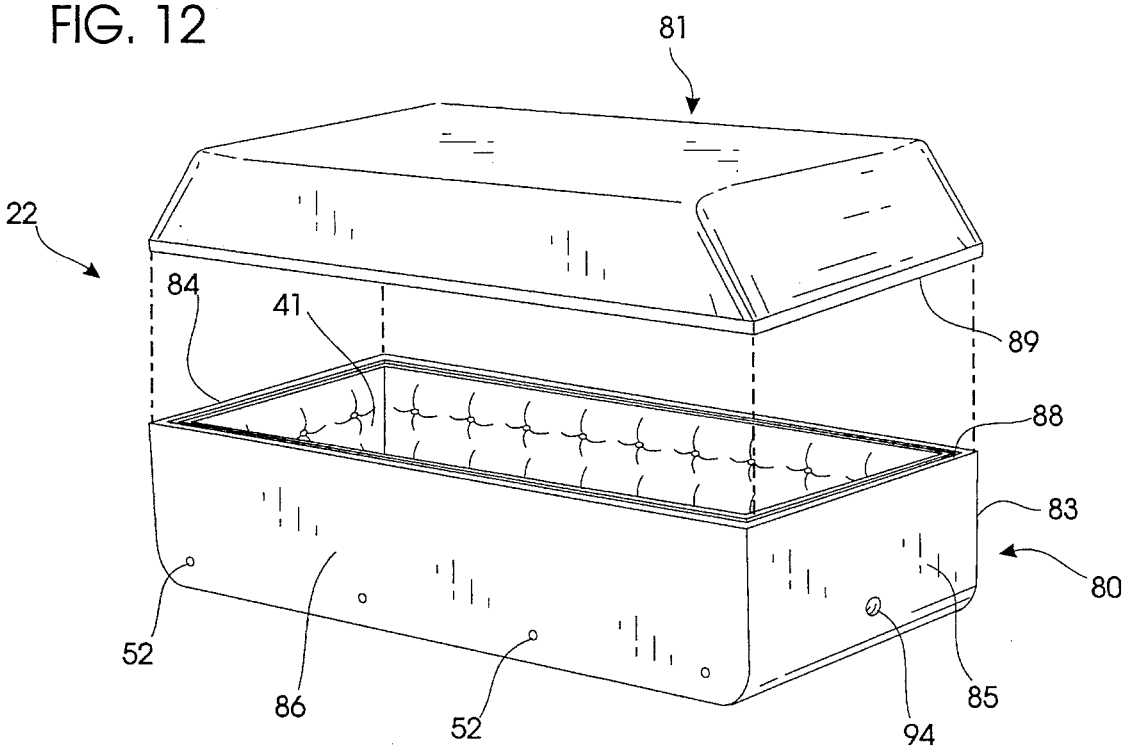
FIG. 12 is an exploded perspective view of the preferred capsule and its lid, illustrating their alignment before assembly.
Figure 13:
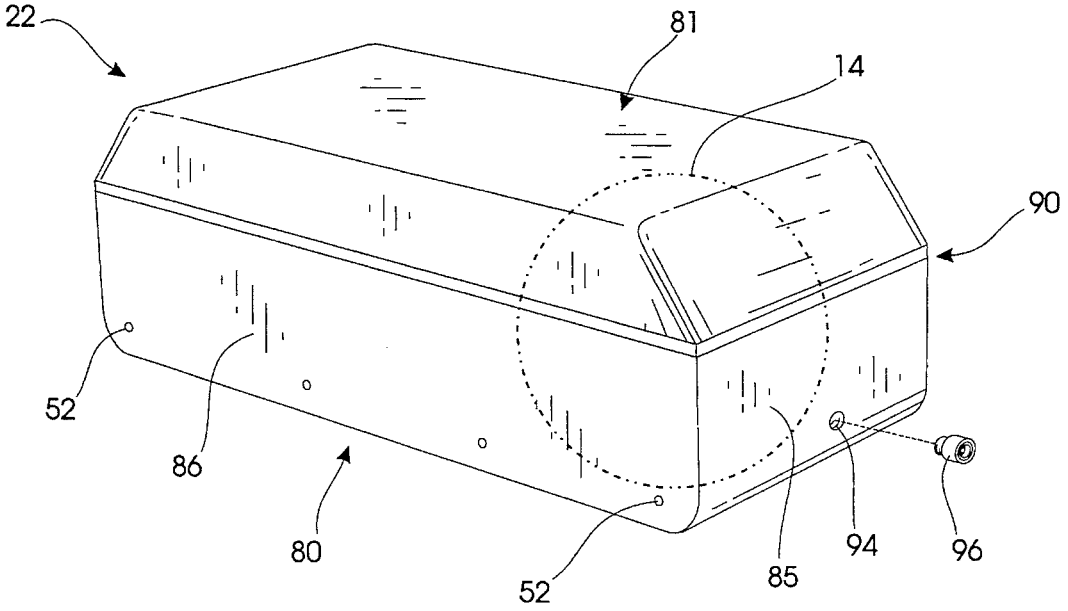
FIG. 13 is a partially exploded perspective view of the capsule with its lid attached, illustrating the optional pressurization chuck.

In order to lock the capsule 22 within the shell 21, the pins 50 must align with and enter the indents 52 in the capsule 22 (FIG. 6, 7 and 8). To accomplish this, the indents 52 are first aligned with the pins 50 by appropriately positioning the shell 21 relative to the capsule 22. Then the tabs 61 are pushed in and locked in latch 64. This action compresses the springs 60. The pins 50 enter the indents 52 where they are captivated, locking the capsule 22 within the shell 21.

When the pins 50 are disengaged, the tab 61 twists to permit the springs 60 to decompress and bias the pins 50 outwardly. The pins 50 move out of the indents 52. In this configuration, the pins 62 extend through the sides of the shell to its inside surface 70. However, the pins 50 do not penetrate into the indents 52. Therefore, the capsule 22 and shell 21 are not interconnected and may be independently moved about.

The inner capsule 22 comprises a body 80 and a lid 81. Preferably, the lid 81 seals the capsule 22 after the shell 21 is removed (FIG. 9–13). When a shell 21 is not used, the lid 81 is attached before the burial.

The body 80 is rectangularly shaped and defines two parallel ends 83, 84 and two parallel sides 85, 86 joined by a bottom 87. The top peripheral edge 88 of the body 80 and the bottom peripheral edge 89 of the lid 81 form seal 90 when appropriately mated.

Figure 14:
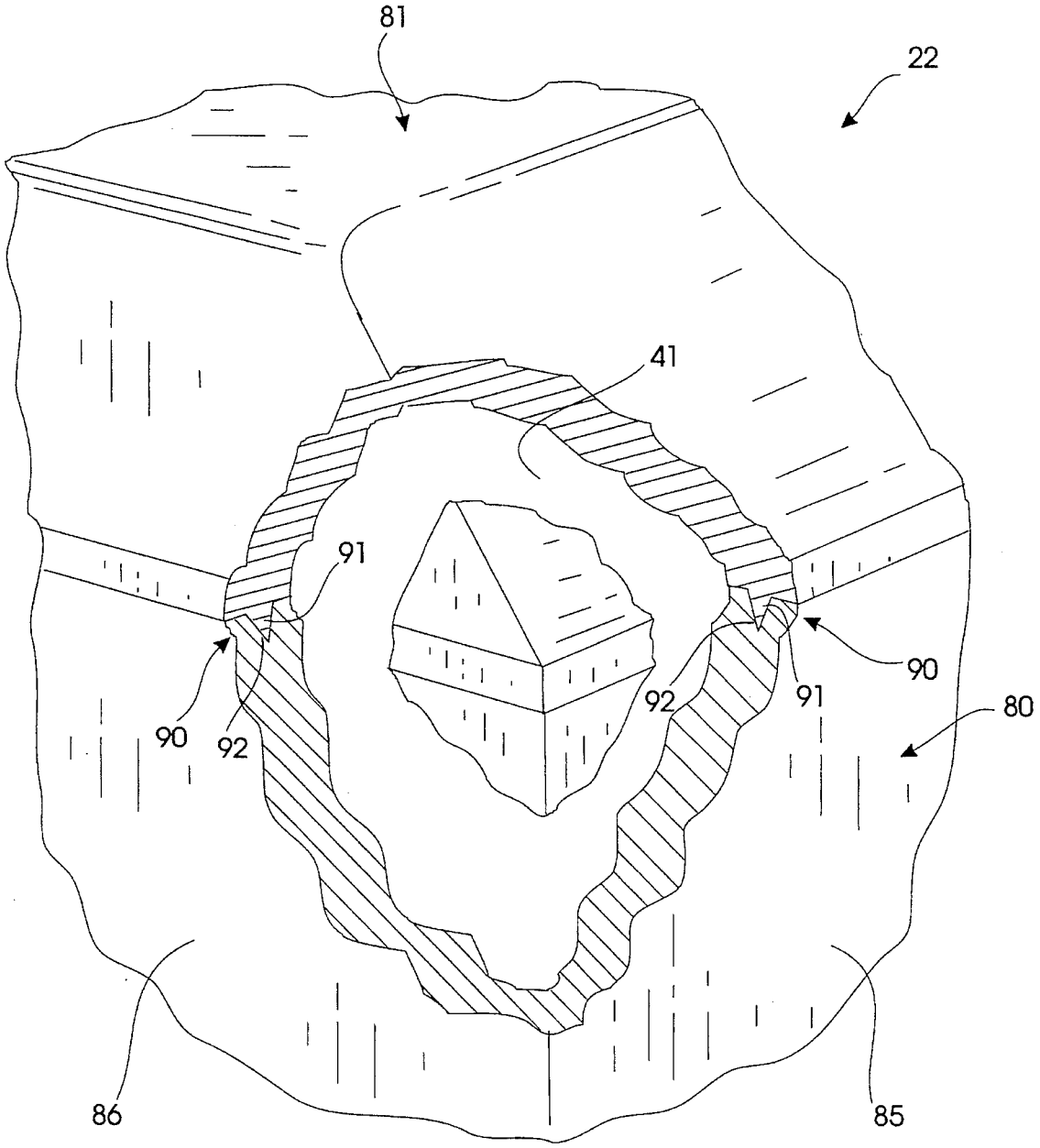
FIG. 14 is a greatly enlarged fragmentary perspective view of the encircled portion of FIG. 13, illustrating the seal between the capsules, and its lid, with portions broken away or omitted for clarity.

The seal 90 comprises a v-shaped tongue 91 that mates with groove 92 to increase the structural strength of the seal formed thereby (FIG. 14). Preferably, the groove 92 is preformed or molded into the capsule's peripheral edge 83. A suitable contact sealant or the like bonds the lid 81 to the body 80 during the sealing process.

Pressure chuck opening 94 in the end wall 83 of the capsule 22 accepts pressure chuck 96. The chuck 96 permits the interior of capsule 22 to be pressurized after the sealing process. Preferably, a stable gas such as nitrogen, is pumped into the interior of the capsule. This pressurization of the interior promotes the hermetic seal of the capsule 22 and the subsequent preservation of the deceased.

Figure 15:
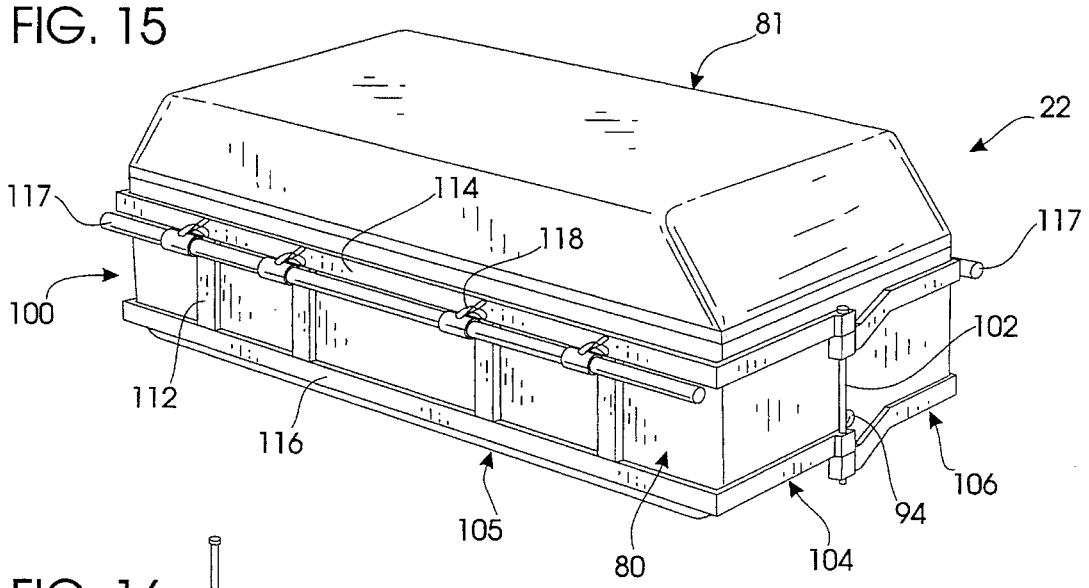
FIG. 15 is a perspective view of the capsule with the auxiliary handle assembly attached; and, FIG. 16 is an exploded perspective view of the capsule and handle assembly, illustrating the preferred method of attaching the handle assembly to the capsule.
Figure 16:
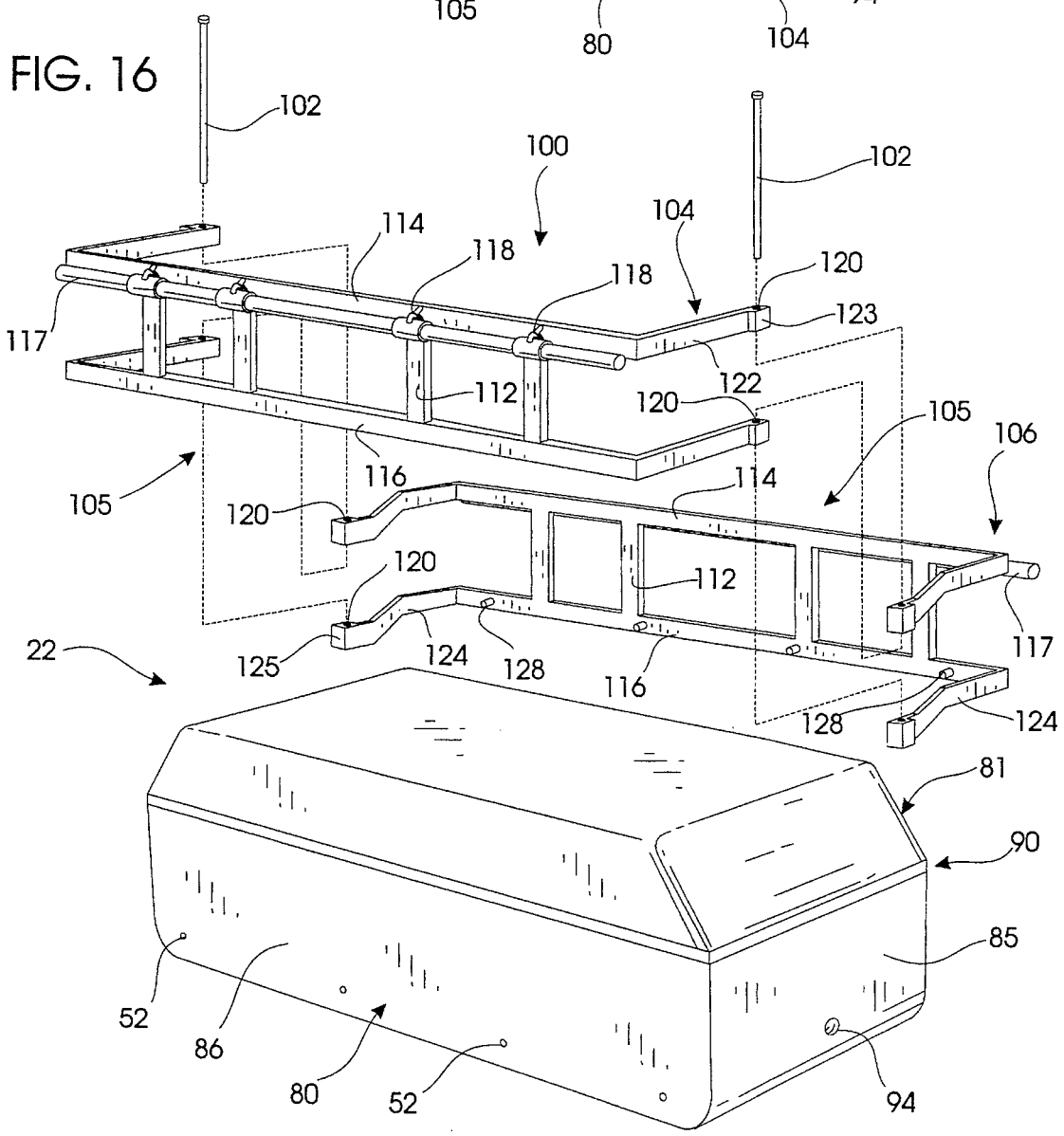

The capsule handle assembly 100 is attached to the capsule 22 to facilitate the subsequent movement and handling of the capsule 22 (FIGS. 15 and 16). This quick connect/disconnect handle assembly 100 preferably comprises complementary halves 104, 106 that are mated together about the capsule perimeter to facilitate handling.

Each half 104, 106 comprises an elongated frame 105. Each frame 105 has an upper, horizontal bar 114 and a lower, parallel bar 116 joined at regular intervals by vertical struts 112. Each frame thus resembles a ladder that is oriented horizontally. Elongated handles 117 depend from the upper bar 114. Struts 118 mounted on the upper bars 114 support the handles 117.

Both halves 104, 106 have orifices 120 formed in both of their distal ends 122, 124 to accommodate the shafts 102. Halves 104, 106 have inwardly turned legs 122, 124 respectively that terminate in apertured feet 123, 125. While legs 122 are relatively straight, legs 124 are bent downwardly (i.e., as viewed in FIG. 16) so as to position feet 125 immediately beneath feet 123 prior to assembly. Orifices 120 in the aligned feet 123, 125 are penetrated by shafts 102 when the halves are coupled together. Thus, when the halves 104, 106 are in place around the capsule 22, shafts 102 slide into the orifices 120 to join the halves 104, 106 and form the handle assembly 100. Importantly, several spaced apart studs 128 are located on lower bar 116. These studs 128 penetrate the same indents 58 in the capsule 22 the pins 50 penetrate. The captivation of the studs 128 and the insertion of the shafts 102 enable the handle assembly 100 to function as a set of semi-permanent handles.

This unique handle assembly 100 permits the capsule 22 to be manipulated independently of the outer shell 21. The handle assembly 100 also quickly assembles and disassembles by simply adding or removing the shafts 102. This ease of operation facilitates the use of the handle assembly immediately prior to the burial of the capsule 22.

OPERATION

In operation, our invention employs an outer shell 21 and an inner capsule 22 to form unitary casket assembly 20. The outer shell 21 is placed over the inner capsule 22 and locked into place. The interconnection of the shell 21 and the capsule 22 is facilitated by a pin assembly 23 mounted to the exterior of the shell 21 and a series of preformed indents in the exterior surface of the capsule 22.

The pin assembly 23 cooperatively engages the indents 52 in the capsule 22. The indents 52 are aligned with the pins 50 in the sides 36, 37 of the outer shell 21. The tabs 61 of the pins 50 are then depressed to compress the springs 60. When the pins 50 are fully captivated by the indents 52, the tabs 61 are twisted and placed in latches 64.

The removal of the tabs 61 from the latches 64 permits the springs 60 to bias the pins 50 outwardly. This results in the liberation of the pins 50 from the indents 52. This liberation destroys the interconnection of the outer shell 21 and the inner capsule 22. The outer shell 21 is subsequently removed from its surrounding position and the capsule 22 may be independently handled.

A lid 81 is subsequently hermetically sealed to the capsule body 80 prior to internment of the capsule 22. The lid 81 has a tongue 91 formed in the peripheral edge of its lower surface. The body 80 has a groove 92 formed in the peripheral lip of its upper surface. The tongue 91 mates with the groove 92 to form a seal 90. A pressurization chuck 96 permits the interior of the capsule to be pressurized with a stable gas to preserve the deceased.

Handle assembly 100 (FIGS. 15, 16) attaches to the capsule 22 to facilitate its independent movement. The handle assembly 100 utilizes several studs 128 to attach to the capsule 22. The studs 128 are inserted into the indents 52. The halves 104, 106 of the handle assembly 100 interlock by inserting the shafts 102 through the orifices 120. Thus assembled, the handle assembly 100 permits the singular use of the capsule 22.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A casket assembly comprising:

an outer shell comprising spaced apart parallel front and rear walls and spaced apart end walls, an open bottom and a hinged lid mounted on said rear wall;

an inner capsule adapted to be semi-permanently disposed within said outer shell in a locking relationship, said capsule comprising a frame and a separable lid, said frame having a generally rectangular base with walls extending upwardly therefrom;

a plurality of indents formed within said capsule walls;

pin assemblies comprising a plurality of moving pins adapted to extend through said front and rear walls, said pins adapted to move between a locked position wherein said pins extend into said indents to lock said capsule within said shell and an unlocked position wherein said pins retract from within said indents to release said capsule from within said shell; and, a handle assembly adapted to fit around said inner capsule, said handle assembly comprising a rectangular frame mounting a plurality of studs adapted to engage said indents to attach said handle assembly to said capsule.

2. The casket assembly as defined in claim 1 wherein said handle assembly further comprises two ladder-like halves, each of said halves comprising spaced apart inturned legs having apertured feet that are adapted to be aligned with one another.

3. The casket assembly as defined in claim 2 further comprising a pair of shafts adapted to penetrate said feet and combine said halves to form said handle assembly.

4. The casket assembly as defined in claim 3 wherein:

said pin assemblies comprise plates adapted to be mounted to suitable channels formed in said walls;

said pin assemblies comprise outer tabs enabling rotation and axial manipulation of said pins;

said plates comprise latches secured to adjacent said pins; and, said tabs may be disposed in locking engagement with said latches.

5. The casket assembly as defined in claim 4 wherein said handle assembly further comprises a bar handle depending from each of said halves for facilitating the movement of said capsule.

6. The casket assembly as defined in claim 5 wherein said inner capsule is adapted to be hermetically sealed.

7. The casket assembly as defined in claim 6 wherein at least one of said capsule walls further comprises chuck means adapted to receive a fitting for pressurizing the interior of said inner capsule.

8. The casket assembly as defined in claim 7 wherein a stable gas is used to pressurized said interior.

9. A casket assembly comprising:

decorative shell means having a generally rectangular frame having side walls and an open bottom and a hinged lid mounted on one of said side walls for forming a hollow chamber;

capsule means adapted to temporarily reside within said hollow chamber and comprising a frame and a separable lid, said frame having a generally rectangular base with walls extending upwardly therefrom, for interning a body;

indent means formed in said capsule for receiving protrusions;

pin means for locking said capsule means within said shell means by engaging said indent means;

handle means adapted to fit around said capsule means for manipulating said capsule means, said handle means comprising two ladder-like halves, each of said halves comprising an upper and a lower elongated bar vertically joined by a plurality of struts, and each of said bars having a pair of spaced apart feet having holes therethrough for joining the halves together; and, stud means formed on said handle means for engaging said indent means to attach said handle means to said capsule means.

10. The casket assembly as defined in claim 9 wherein said handle means further comprises a handle depending from each of said upper bars, said handle facilitating the movement of said capsule.

11. The casket assembly as defined in claim 10 wherein said handle means further comprises shaft means for combining said halves by penetrating said feet to secure said handle means about the capsule means.

12. The casket assembly as defined in claim 11 wherein said capsule means is adapted to be hermetically sealed to protect and preserve the deceased.

13. The casket assembly as defined in claim 12 wherein said capsule means further comprises chuck means adapted to receive a fitting for pressurizing the interior of said inner capsule.

14. The casket assembly as defined in claim 13 wherein an inert gas is used to pressurized said interior.

15. A reusable casket assembly wherein an ornate, decorative outer shell is used to surround an inexpensive inner capsule that is separately interred within a grave and wherein the inner capsule utilizes a handle assembly that facilitates subsequent movement of the inner capsule after separation from the outer shell, said casket assembly comprising:

a decorative outer shell having a front and a rear side and two end walls;

a decorative cover hinged to said rear side, said cover split into two independently operable halves;

a plurality of manually operated, spring biased pin assemblies, each having an engaged and a disengaged position, said assemblies comprising a plurality of pins mounted on said front and rear sides, said pins disposed within said front and rear sides;

a decorative inner capsule adapted to be disposed within said outer shell in a temporary locking relationship, said capsule comprising a body and a separable lid, said body having a generally rectangular base with sidewalls extending upwardly therefrom, said sidewalls having a plurality of indents formed therein adapted to receive said pins when said pins are engaged;

a ladder-like handle assembly adapted to fit around said inner capsule, said handle assembly comprising two halves, each of said halves comprising an upper and a lower elongated bar vertically joined by a plurality of struts, each of said bars having spaced apart inturned legs having apertured feet that are adapted to be aligned with one another;

a plurality of studs formed on each of said lower bars, said studs adapted to penetrate said indents to facilitate manipulation of said capsule;

a handle depending from each of said upper bars, said handle facilitating the movement of said capsule; and, at least two shafts adapted to penetrate said feet to unify said halves to form said handle assembly.

16. The casket assembly as defined in claim 15 wherein said capsule means is adapted to be hermetically sealed to protect and preserve the deceased.

17. The casket assembly as defined in claim 16 wherein said capsule means further comprises chuck means adapted to receive a fitting for pressurizing the interior of said inner capsule.

18. The casket assembly as defined in claim 17 wherein an inert gas is used to pressurized said interior.

* * * * *